US008857640B1

(12) United States Patent
Yorks

(10) Patent No.: US 8,857,640 B1
(45) Date of Patent: Oct. 14, 2014

(54) EASY-FILL WATER BOTTLE SYSTEM

(71) Applicant: Rangal H. Yorks, Millbrae, CA (US)

(72) Inventor: Rangal H. Yorks, Millbrae, CA (US)

( * ) Notice: Subject to any disclaimer, the term of this patent is extended or adjusted under 35 U.S.C. 154(b) by 0 days.

(21) Appl. No.: 13/961,020

(22) Filed: Aug. 7, 2013

Related U.S. Application Data

(63) Continuation-in-part of application No. 13/050,390, filed on Mar. 17, 2011, now abandoned.

(51) Int. Cl.
*B65D 1/06* (2006.01)

(52) U.S. Cl.
USPC ..... 215/329; 215/2

(58) Field of Classification Search
CPC .... B67D 1/805; B67D 1/0891; B67D 1/0004; B67D 3/0035; B65D 1/06
USPC ..... 222/184, 185.1; 215/2, 329; 220/916, 220/601, 288; 141/18
See application file for complete search history.

(56) References Cited

U.S. PATENT DOCUMENTS 1,163,571 A * 12/1915 Stiegler ..... 222/185.1
1,513,935 A * 11/1924 Schatz ..... 62/397
2,779,472 A * 1/1957 Febbraro ..... 210/514
3,430,795 A 3/1969 Laufer
3,653,413 A * 4/1972 Sheya ..... 141/1
4,030,634 A 6/1977 Osborn
RE33,083 E * 10/1989 Pellegrino ..... 222/288
4,881,661 A 11/1989 Jones
5,417,327 A 5/1995 Saumure
5,611,459 A 3/1997 Hinch
D387,665 S 12/1997 Eichhorn
5,829,607 A 11/1998 Ibrahim
6,056,154 A 5/2000 Fowler
6,155,460 A 12/2000 Lee
6,286,564 B1 * 9/2001 Wallace ..... 141/18
6,648,160 B2 * 11/2003 Hotch ..... 220/255
6,648,184 B1 11/2003 Williams et al.
7,597,215 B2 10/2009 Sleiman

* cited by examiner

*Primary Examiner* — Stephen Castellano

(57) ABSTRACT

An easy-fill water bottle system features a water bottle. A bottle first end features a tapering hollow neck with a neck aperture and a bottle second end features a cylindrical channel with a first shoulder located close to a channel midpoint and a second shoulder located close to a channel second end. The channel features threads from the channel midpoint to a channel first end. The system features a flush cylindrical lid having a first lid shoulder located close to a lid midpoint and a second lid shoulder located close to a lid second end. The lid features threads located from the lid midpoint to a lid first end. The lid second end features a plurality of indentions. The system features a water dispenser adapted to receive and fluidly connect to the bottle first end.

5 Claims, 4 Drawing Sheets

EASY-FILL WATER BOTTLE SYSTEM

CROSS REFERENCE

This application claims priority to U.S. patent application Ser. No. 13/050,390, filed Mar. 17, 2001, now abandoned the specification(s) of which is/are incorporated herein in their entirety by reference.

FIELD OF THE INVENTION

The present invention relates to water bottle systems, or more specifically, water bottle systems incorporating an easy-fill opening.

BACKGROUND OF THE INVENTION

Water coolers are a common sight in many work places and homes. Typically, a replaceable five-gallon water bottle is opened and set on a water dispenser or combined dispenser and cooler. Water bottles can be difficult and messy to change, due to the weight of the water (over 40 lbs.) as well as an open bottle top. The present invention features an easy-fill water bottle system having a large refill opening.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features an easy-fill water bottle system. In some embodiments, the system comprises a water bottle. In some embodiments, a bottle first end comprises a tapering hollow neck having a neck aperture. In some embodiments, the bottle second end comprises a cylindrical channel centrally located therein. In some embodiments, the channel comprises a first shoulder located close to the channel midpoint thereon and a second shoulder located close to the channel second end thereon. In some embodiments, the channel comprises threads located therein from the channel midpoint to the channel first end.

In some embodiments, the system comprises a flush cylindrical lid. In some embodiments, the lid comprises a first lid shoulder located close to the lid midpoint thereon and a second lid shoulder located close to the lid second end thereon. In some embodiments, the lid comprises threads located thereon from the lid midpoint to the lid first end. In some embodiments, the first lid shoulder is designed to be a first lid sealing surface. In some embodiments, the second lid shoulder is designed to be a second lid sealing surface. In some embodiments, the lid second end comprises a plurality of indentions radially located thereon.

In some embodiments, the system comprises a water dispenser adapted to receive and fluidly connect to the bottle first end.

DESCRIPTION OF PREFERRED EMBODIMENTS

Figure 1:
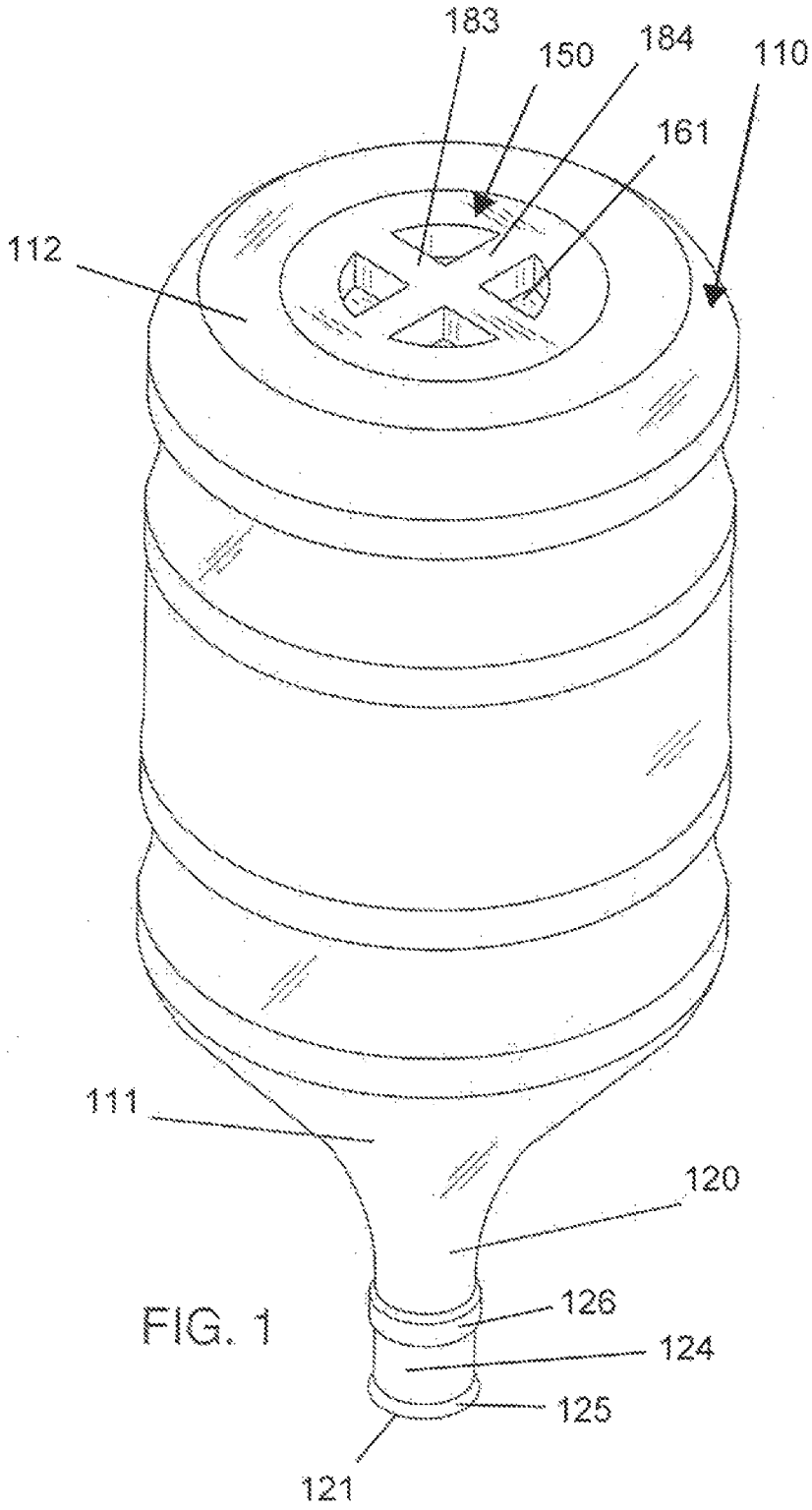
FIG. 1 shows a perspective view of the water bottle and the lid of the present invention.
Figure 2:
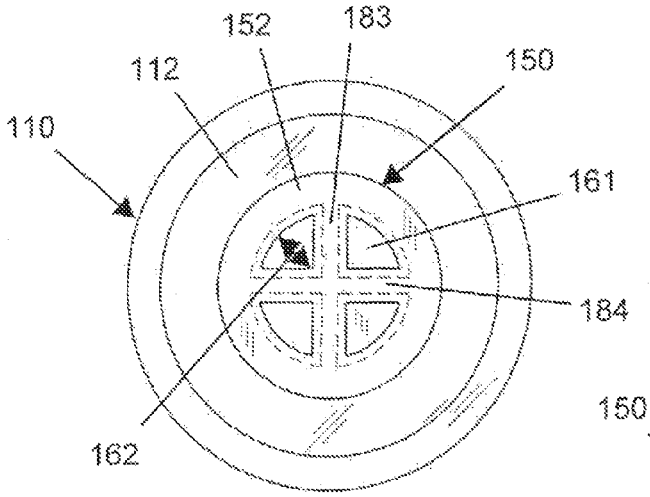
FIG. 2 shows a top view of the water bottle and the lid of the present invention.
Figure 3:
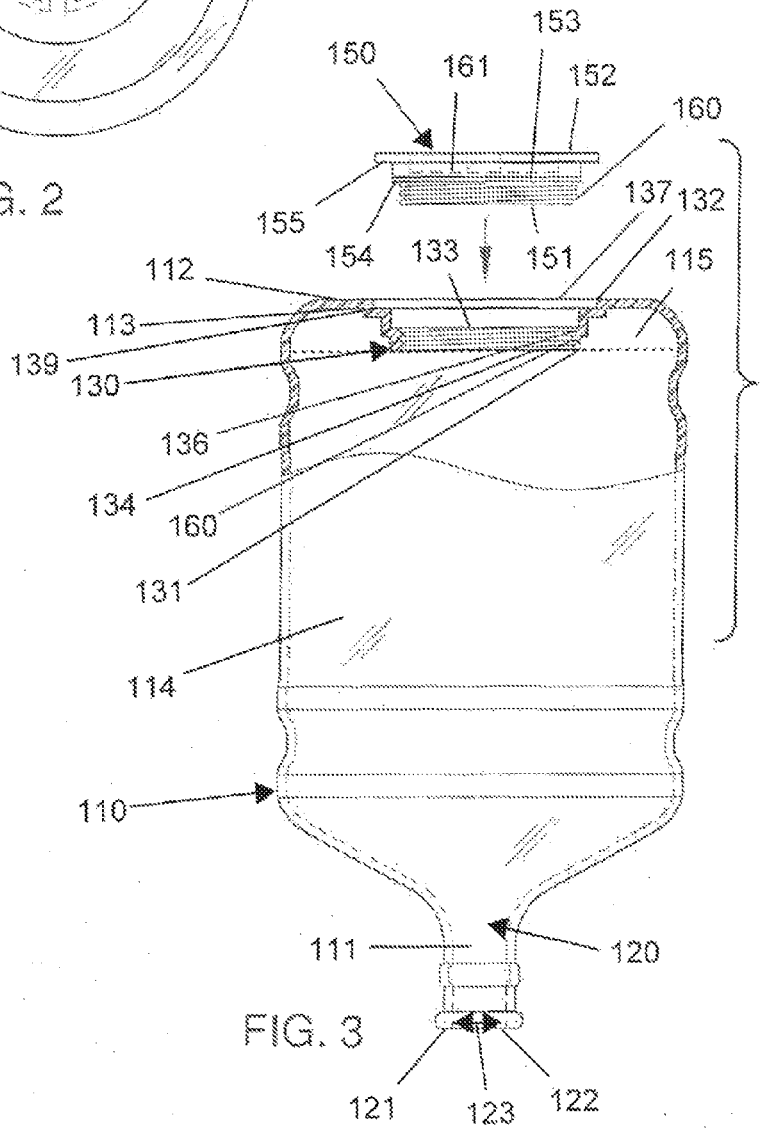
FIG. 3 shows a side view with a partial cutaway of the water bottle and the lid of the present invention.
Figure 4:
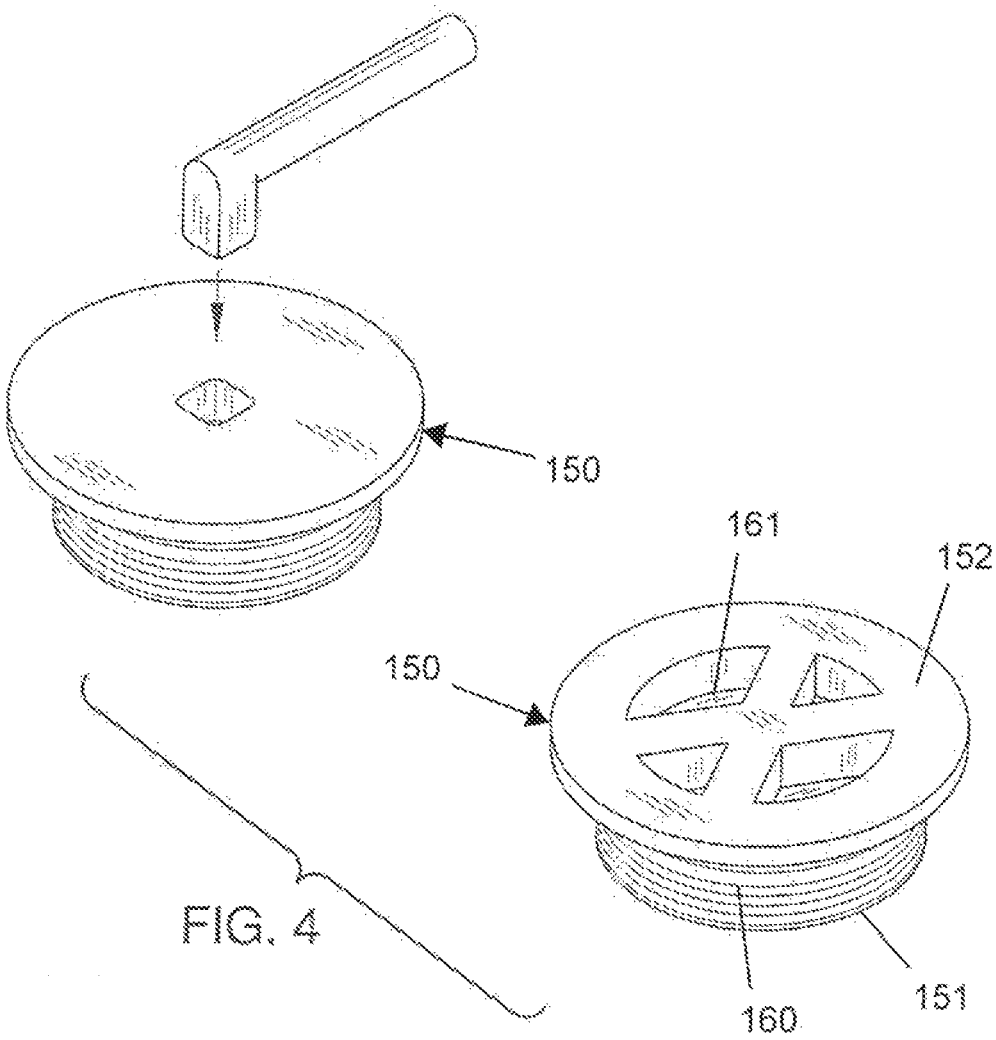
FIG. 4 shows a perspective view of the lid and an alternate embodiment of the lid of the present invention.
Figure 5:
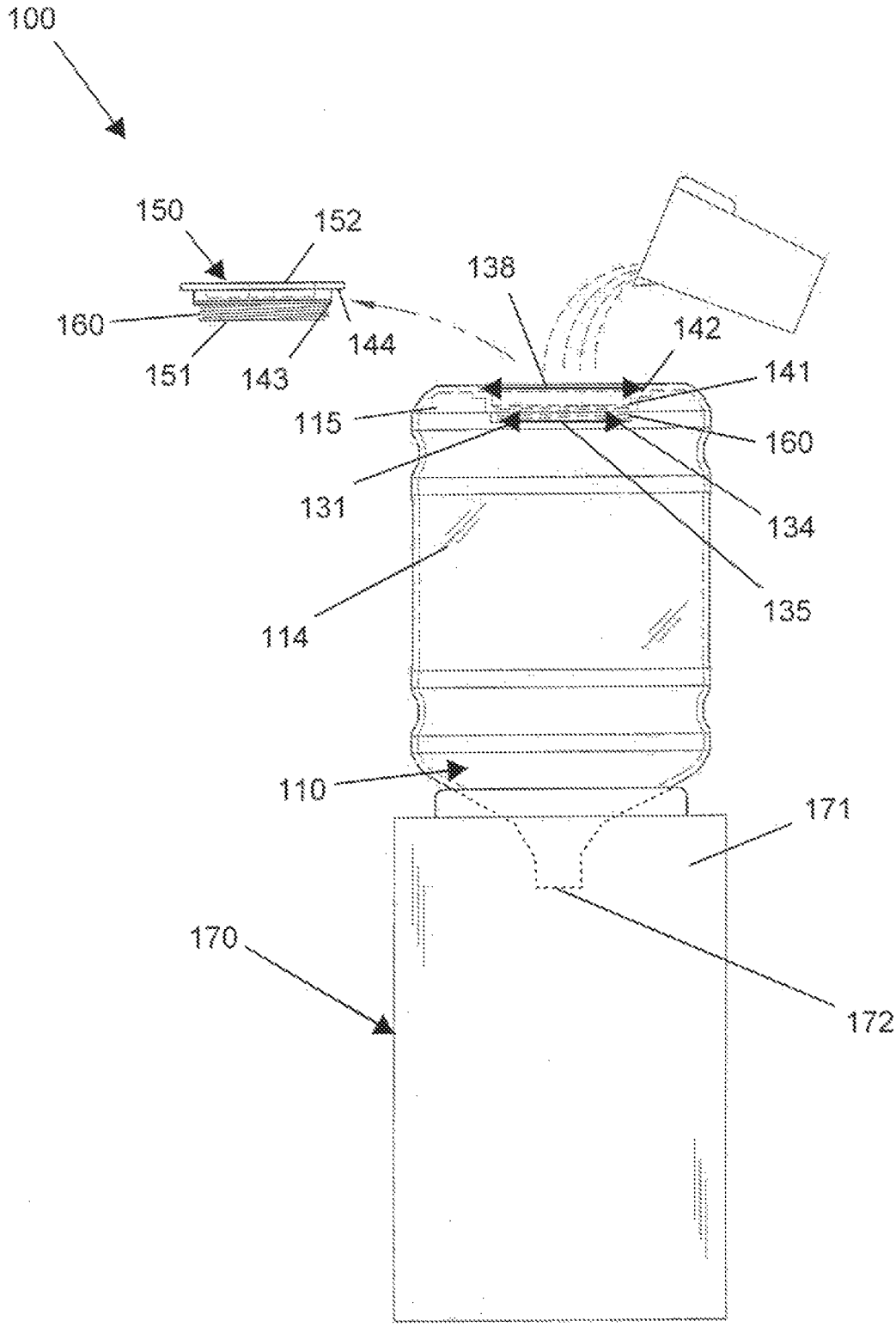
FIG. 5 shows a side view of the present invention.

Following is a list of elements corresponding to a particular element referred to herein:

100 Water bottle system
110 Water bottle
111 Bottle first end
112 Bottle second end
113 Bottle second end inside surface
114 Bottle cavity
115 Annular headspace
120 Neck
121 Neck end
122 Neck aperture
123 Neck aperture diameter
124 Neck outer periphery
125 First neck ring
126 Second neck ring
130 Cylindrical channel
131 Channel first end
132 Channel second end
133 Channel midpoint
134 First channel aperture
135 First channel aperture diameter
136 First channel shoulder
137 Second channel aperture
138 Second channel aperture diameter
139 Second channel shoulder
141 First sealing surface
142 Second sealing surface
143 First lid sealing surface
144 Second lid sealing surface
150 Lid
151 Lid first end
152 Lid second end
153 Lid midpoint
154 First lid shoulder
155 Second lid shoulder
160 Threads
161 Indention
162 Indention diameter
170 Water dispenser
171 Dispenser top
172 Dispenser aperture
183 First bar
184 Second bar Referring now to FIG. 1-5, the present invention features an easy-fill water bottle system (100) for improving safety and reducing messiness caused by water bottle changes by providing an easy to fill opening on the water bottle. In some embodiments, the system (100) comprises a water bottle (110) having a bottle first end (111), a planar bottle second end (112), and a bottle cavity (114) located therein.

In some embodiments, the bottle first end (111) comprises a tapering hollow neck (120) having a terminating neck end (121) with a neck aperture (122) centrally located thereon. In some embodiments, the neck aperture (122) is fluidly connected to the bottle cavity (114).

In some embodiments, a first neck ring (125) is located around a neck outer periphery (124) adjacent to the neck end (121) and a second neck ring (126) is located around the neck outer periphery (124) offset from the first neck ring (125).

In some embodiments, the bottle second end (112) comprises a cylindrical channel (130) centrally located therein.

In some embodiments, the cylindrical channel (130) comprises a channel first end (131), a channel second end (132), and a channel midpoint (133).

In some embodiments, the channel second end (132) is located flush with the bottle second end (112) and the channel first end (131) is located offset from the bottle second end (112). In some embodiments, the offset is about ½". In some embodiments, the offset is about ¾". In some embodiments, the offset is about 1". In some embodiments, the offset is about 1¼". In some embodiments, the offset is about 1½" or more. In some embodiments, the channel first end (131) protrudes into the bottle cavity (114) out and away from a bottle second end inside surface (113) forming an annular headspace (115) in the bottle cavity (114) from the bottle second end (112) to the channel first end (131). In some embodiments, a first channel aperture (134) is located on the channel first end (131) and is fluidly connected to the cylindrical channel (130) and the bottle cavity (114). In some embodiments, a second channel aperture (137) is located on the channel second end (132) and is fluidly connected to the cylindrical channel (130).

In some embodiments, the cylindrical channel (130) comprises a first channel shoulder (136) located close to the channel midpoint (133) thereon and a second channel shoulder (139) located close to the channel second end (132) thereon.

In some embodiments, the cylindrical channel (130) comprises threads (160) located therein from the channel midpoint (133) to the channel first end (131).

In some embodiments, the first channel aperture (134) comprises a first channel aperture diameter (135). In some embodiments, the second channel aperture (137) comprises a second channel aperture diameter (138). In some embodiments, the first channel aperture (134) and the second channel aperture (137) each comprise a diameter at least two times a neck aperture diameter (123).

In some embodiments, the first channel shoulder (136) is designed to be a first sealing surface (141). In some embodiments, the second channel shoulder (139) is designed to be a second sealing surface (142).

In some embodiments, the system (100) comprises a flush cylindrical lid (150) having a planar lid first end (151), a planar lid second end (152), and a lid midpoint (153).

In some embodiments, the lid (150) comprises a first lid shoulder (154) located close to the lid midpoint (153) thereon and a second lid shoulder (155) located close to the lid second end (152) thereon.

In some embodiments, the lid (150) comprises threads (160) located thereon from the lid midpoint (153) to the lid first end (151).

In some embodiments, the first lid shoulder (154) is designed to be a first lid sealing surface (143). In some embodiments, the second lid shoulder (155) is designed to be a second lid sealing surface (144).

In some embodiments, the lid second end (152) comprises a plurality of indentions (161) radially located thereon. In some embodiments, at least two indentions (161) comprise an indention diameter (162) greater than a diameter of a finger of a user. In some embodiments, the plurality of indentions (161) is designed to accept a plurality of fingers of the user for providing leverage to unscrew the lid (150) from the cylindrical channel (130). In some embodiments, the indention diameter (162) is at least ½".

In some embodiments, the system (100) comprises a water dispenser (170). In some embodiments, the water dispenser (170) comprises a conical dispenser top (171) having an dispenser aperture (172) located thereon. In some embodiments, the dispenser top (171) is adapted to receive and fluidly connect to the bottle first end (111).

In some embodiments, when refilling the water bottle (110), the lid (150) is removed from the cylindrical channel (130) via unscrewing the mated threads (160) of the cylindrical channel (130) and the lid (150). In some embodiments, water is poured through the cylindrical channel (130). In some embodiments, the lid (150) is replaced in the cylindrical channel (130) via screwing the mated threads (160) of the cylindrical channel (130) and the lid (150).

In some embodiments, a first gasket is located between the first channel shoulder (136) and the first lid shoulder (154). In some embodiments, a second gasket is located between the second channel shoulder (139) and the second lid shoulder (155). In some embodiments, no gasket is located between the seating first channel shoulder (136) and the first lid shoulder (154). In some embodiments, no gasket is located between the seating second channel shoulder (139) and the second lid shoulder (155).

In some embodiments, the water bottle (110) is a five gallon water bottle. In some embodiments, the water bottle (110) is a one gallon water bottle. In some embodiments, the water bottle (110) is a two gallon water bottle. In some embodiments, the water bottle (110) is a three gallon water bottle. In some embodiments, the water bottle (110) is a four gallon water bottle.

In some embodiments, the lid second end (152) comprises a flush first bar (183) located thereon and a flush second bar (184) perpendicularly located thereon with respect to the first bar (183). In some embodiments, the first bar (183) and the second bar (184) together resemble a shape of an "X".

As used herein, the term "about" refers to plus or minus 10% of the referenced number.

The disclosures of the following U.S. Patents are incorporated in their entirety by reference herein: U.S. Pat. No. 6,648,184; U.S. Pat. No. 4,030,634; and U.S. Pat. No. 3,430,795.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. An easy-fill water bottle system (100) for improving safety and reducing messiness caused by water bottle changes by providing an easy to fill opening on the water bottle, wherein the system (100) comprises:

(a) a water bottle (110) having a bottle first end (111), a planar bottle second end (112), and a bottle cavity (114) disposed therein, wherein the bottle first end (111) comprises a tapering hollow neck (120) having a terminating neck end (121) with a neck aperture (122) centrally disposed thereon, wherein the neck aperture (122) is fluidly connected to the bottle cavity (114), wherein a first neck ring (125) is disposed around a neck outer periphery (124) adjacent to the neck end (121) and a second neck ring (126) is disposed around the neck outer periphery (124) offset from the first neck ring (125), wherein the bottle second end (112) comprises a cylindrical channel (130) centrally disposed therein, wherein the cylindrical channel (130) comprises a channel first end (131), a channel second end (132), and a channel midpoint (133), wherein the channel second end (132) is disposed flush with the bottle second end (112) and the channel first end (131) is disposed offset from the bottle second end (112), wherein the channel first end (131) protrudes into the bottle cavity (114) out and away from a bottle second end inside surface (113) forming an annular headspace (115) in the bottle cavity (114) from the bottle second end (112) to the channel first end (131), wherein a first channel aperture (134) is disposed on the channel first end (131) and is fluidly connected to the cylindrical channel (130) and the bottle cavity (114), wherein a second channel aperture (137) is disposed on the channel second end (132) and is fluidly connected to the cylindrical channel (130), wherein the cylindrical channel (130) comprises a first channel shoulder (136) disposed proximal to the channel midpoint (133) thereon and a second channel shoulder (139) disposed proximal to the channel second end (132) thereon, wherein the cylindrical channel (130) comprises threads (160) disposed therein from the channel midpoint (133) to the channel first end (131), wherein the first channel aperture (134) comprises a first channel aperture diameter (135), wherein the second channel aperture (137) comprises a second channel aperture diameter (133), wherein the first channel aperture diameter (135) and the second channel aperture diameter (138) each comprise a diameter at least two times a neck aperture diameter (123), wherein the first channel shoulder (136) is designed to be a first sealing surface (141), wherein the second channel shoulder (139) is designed to be a second sealing surface (142);

(b) a flush cylindrical lid (150) having a planar lid first end (151), a planar lid second end (152), and a lid midpoint (153), wherein the lid (150) comprises a first lid shoulder (154) disposed proximal to the lid midpoint (153) thereon and a second lid shoulder (155.) disposed proximal to the lid second end (152) thereon, wherein the lid (150) comprises threads (160) disposed thereon from the lid midpoint (153) to the lid first end (151), wherein the first lid shoulder (154) is designed to be a first lid sealing surface (143), wherein the second lid shoulder (155) is designed to be a second lid sealing surface (144), wherein the lid second end (152) comprises a plurality of indentions (161) radially disposed thereon, wherein at least two indentions (161) comprise a indention diameter (162) greater than a diameter of a finger of a user, wherein the plurality of indentions (161) is designed to accept a plurality of fingers of the user for providing leverage to unscrew the lid (150) from the cylindrical channel (130); and (c) a water dispenser (170), wherein the water dispenser (170) comprises a conical dispenser top (171) having a dispenser aperture (172) disposed thereon, wherein the dispenser top (171) is adapted to receive and fluidly connect to the bottle first end (111);

wherein when refilling the water bottle (110), the lid (150) is removed from the cylindrical channel (130) via unscrewing the mated threads (160), wherein water is poured through the cylindrical channel (130), wherein the lid (150) is replaced in the cylindrical channel (130) via screwing the mated threads (160).

2. The system (100) of claim 1, wherein a first gasket is disposed between the first channel shoulder (136) and the first lid shoulder (154).

3. The system (100) of claim 1, wherein a second gasket is disposed between the second channel shoulder (139) and the second lid shoulder (155).

4. The system (100) of claim 1, wherein the water bottle (110) is a five gallon water bottle.

5. The system (100) of claim 1, wherein the lid second end (152) comprises a flush first bar (183) disposed thereon and a flush second bar (184) perpendicularly disposed thereon with respect to the first bar (183), wherein the first bar (183) and the second bar (184) together resemble a shape of an "X".

* * * * *